US012558591B2

(12) United States Patent
Pritchett

(10) Patent No.: US 12,558,591 B2
(45) Date of Patent: Feb. 24, 2026

(54) WEIGHTLIFTING APPARATUS

(71) Applicant: Coulter Ventures, LLC., Columbus, OH (US)

(72) Inventor: Martin Pritchett, Columbus, OH (US)

(73) Assignee: Coulter Ventures, LLC., Columbus, OH (US)

( * ) Notice: Subject to any disclaimer, the term of this patent is extended or adjusted under 35 U.S.C. 154(b) by 23 days.

(21) Appl. No.: 18/649,437

(22) Filed: Apr. 29, 2024

(65) Prior Publication Data

US 2024/0359049 A1 Oct. 31, 2024

Related U.S. Application Data

(60) Provisional application No. 63/462,672, filed on Apr. 28, 2023.

(51) Int. Cl.

| | |
|---|---|
| ***A63B 21/00*** | (2006.01) |
| ***A63B 21/16*** | (2006.01) |
| ***A63B 23/12*** | (2006.01) |

(52) U.S. Cl.

CPC .... *A63B 21/4035* (2015.10); *A63B 21/00047* (2013.01); *A63B 21/169* (2015.10); *A63B 23/1227* (2013.01)

(58) Field of Classification Search

CPC ..... A63B 3/00; A63B 21/00047; A63B 21/00054; A63B 21/068; A63B 21/1618;

(Continued)

(56) References Cited

U.S. PATENT DOCUMENTS 4,620,701 A * 11/1986 Mojden ..... A63B 3/00 482/142

D321,735 S 11/1991 Blubaugh (Continued)

FOREIGN PATENT DOCUMENTS

CN 108591201 A * 9/2018 ..... B32B 7/08

CN 217493306 U 9/2022

(Continued)

OTHER PUBLICATIONS

Product listing for Rogue Monster Lite Matador, From: https://www.roguefitness.com/rogue-monster-lite-matador, dated Jun. 14, 2014, accessed Feb. 20, 2022.

(Continued)

*Primary Examiner* — Gary D Urbiel Goldner

(74) *Attorney, Agent, or Firm* — Banner & Witcoff, Ltd.

(57) ABSTRACT

A weightlifting apparatus, which may be in the form of a dip apparatus, includes a mounting portion for attachment to a vertical post, an arm structure extending laterally, and a connecting member extending longitudinally to connect the mounting portion to the arm structure to form a fixed joint, with a brace member to engage the connecting member and the arm structure to reinforce the fixed joint. The brace member has a top surface engaging a bottom wall of the connecting member and a bottom surface of the arm structure, with a leg extending from the top surface. The leg has an upright portion extending upward from the top surface and through a slot in the bottom wall of the connecting member into a central cavity, and a protruding portion extending forward from the upright portion within the central cavity to engage a rear wall of the arm structure.

20 Claims, 12 Drawing Sheets

(58) Field of Classification Search
CPC ..... A63B 21/169; A63B 21/4027; A63B 21/4035; A63B 23/1218; A63B 23/1227; F16B 9/00; F16B 9/09
See application file for complete search history.

(56) References Cited

U.S. PATENT DOCUMENTS

| | | | | |
|---|---|---|---|---|
| 5,273,509 | A | 12/1993 | Vittone | |
| 5,417,628 | A | 5/1995 | Vanderbleek | |
| 5,645,078 | A * | 7/1997 | Marmer | A63B 21/4035 600/595 |
| 6,217,483 | B1 * | 4/2001 | Kallassy | A63B 21/068 482/41 |
| D550,791 | S | 9/2007 | Rogers et al. | |
| D551,306 | S | 9/2007 | Rogers et al. | |
| 7,837,598 | B1 | 11/2010 | Boozel, Jr. | |
| D633,961 | S | 3/2011 | Loew et al. | |
| D727,711 | S | 4/2015 | Deily | |
| 9,452,308 | B2 | 9/2016 | Lentz et al. | |
| D818,061 | S | 5/2018 | Barton et al. | |
| D850,543 | S | 6/2019 | Lau | |
| 10,376,727 | B2 | 8/2019 | Fitzpatrick | |
| D863,467 | S | 10/2019 | Weng | |
| D895,743 | S | 9/2020 | Lau | |
| D936,761 | S | 11/2021 | Jiang | |
| D953,449 | S | 5/2022 | Pan | |
| D968,535 | S | 11/2022 | Wang | |
| D970,655 | S | 11/2022 | Jones | |
| D981,509 | S | 3/2023 | Qi | |
| D1,017,740 | S | 3/2024 | Carrington, III et al. | |
| D1,018,729 | S | 3/2024 | Mao | |
| D1,022,082 | S | 4/2024 | Lu | |
| D1,055,185 | S * | 12/2024 | Pritchett | D21/694 |
| D1,065,380 | S * | 3/2025 | Pritchett | D21/679 |
| 2012/0329626 | A1 | 12/2012 | Meredith et al. | |
| 2017/0189734 | A1 | 7/2017 | Wang | |
| 2018/0142832 | A1 * | 5/2018 | Inouye | F16M 13/022 |
| 2018/0243597 | A1 * | 8/2018 | Schlegel | A63B 23/047 |
| 2019/0247701 | A1 * | 8/2019 | Sergakis | F16B 45/00 |
| 2020/0276469 | A1 * | 9/2020 | Anderson | A63B 21/072 |
| 2022/0203153 | A1 * | 6/2022 | Sergakis | A63B 17/04 |
| 2023/0204154 | A1 * | 6/2023 | Inouye | F16M 13/022 248/221.11 |
| 2024/0042274 | A1 | 2/2024 | Hywel | |
| 2024/0050797 | A1 * | 2/2024 | Miller | A63B 21/068 |
| 2024/0157195 | A1 * | 5/2024 | Pritchett | A63B 21/0724 |

FOREIGN PATENT DOCUMENTS

| | | |
|---|---|---|
| GB | 6197814 | 3/2022 |
| GB | 6303593 | 8/2023 |

OTHER PUBLICATIONS

Product listing for Rogue Monster Matador, From: <https://www.roguefitness.com/rogue-monster-matador>, dated Jun. 14, 2014, accessed Feb. 20, 2022.

Product listing for Rogue Infinity Matador, From:<https://www.roguefitness.com/rogue-monster-matador>, dated Aug. 3, 2020, accessed Feb. 20, 2022.

"Mutant Metals"; Instagram; retrieved Feb. 16, 2023; published Apr. 27, 2021; URL: <https://www.instagram.com/p/COLxvuWgBKk/ >.

"Primalarmor"; Instagram; retrieved Feb. 16, 2023; published Oct. 29, 2022; URL: <https://www.instagram.com/p/CKTSVLPudfn/ >.

The Ultimate Dip Attachment; product listing; https:/web.archive.org/web/20210521174630/https:/mutantmetals.com/products/p/cfnu97n1rgnzjbpfuvh4ruempgpsvo; 4 pages; May 21, 2021; downloaded Nov. 14, 2023.

Ultimate Dip Attachment; <https://www.youtube.com/watch?v=Y58UqdLhs1k> (dated Jan. 10, 2021).

Rogue, Rogue Velocidor, published Apr. 2023 [online]. Retrieved from internet (Date: Mar. 25, 2024), https://www.roguefitness.com/rogue-velocidor (Year: 2023).

Mikola, Dip Bar Attachment, published on Oct. 18, 2023 [online]. Retrieved from internet (Date: Mar. 25, 2024), https://www.amazon.com/Mikolo-Attachment-Mounted-Weight-Capacity/dp/B0CL9HV87Y/?th=1 (Year: 2023).

Garage Gym Reviews, Rogue Velocidor Dip Attachment Review, published on Apr. 14, 2023 [online]. Retrieved from internet (Date: Mar. 25, 2024), https://www.youtube.com/watch?v=DI5b1Q4UBOO (Year: 2023).

Rogue, Mutant Metals Ultimate Dip Attachment (UDA), published on Jun. 2023 [online]. Retrieved from internet (Date: Jun. 12, 2024), https://www.roguefitness.com/mutant-metals-ultimate-dip-attachments-uda (Year: 2023).

Garage Gym Gainz, Mutant Metals VS Rogue Fitness Dip Attachment, published on Jan. 13, 2021 [online]. Retrieved from internet (Date: Jun. 12, 2024), https://www.youtube.com/watch?v=p9xvw9Nu0IQ (Year: 2021).

* cited by examiner

WEIGHTLIFTING APPARATUS

CROSS-REFERENCE TO RELATED APPLICATION

This application is a nonprovisional of, and claims priority to, U.S. Provisional Application No. 63/462,672, filed Apr. 28, 2023, which prior application is incorporated by reference herein in its entirety.

TECHNICAL FIELD

This disclosure relates to a weightlifting apparatus, and more specifically to a weightlifting attachment, e.g., a dip apparatus, having handles that are adjustable among a plurality of different positions.

BACKGROUND

A large number of weightlifting apparatuses exist that facilitate a user performing a "dip" exercise, in which a user grips two handles that are spaced apart and lowers and raises their body between the handles. Such apparatuses may be stand-alone equipment or attachments for connection to another piece of equipment, such as a weight rack. The fixed components of such apparatuses are typically connected together by welding at weld joints. However, due to the cantilevered configuration of such dip apparatuses, a high degree of stress can be placed on the joints of the apparatus, particularly the joints that are furthest from the upright or frame member to which the apparatus is attached. The weld joints used for existing dip apparatuses may not provide sufficient strength at such joints. Additionally, the weld joints used for existing dip apparatuses provide no safety features if the weld should break.

The present disclosure is provided to address this need and other needs in existing dip apparatuses and similar weightlifting attachments and apparatuses. A full discussion of the features and advantages of the present invention is deferred to the following detailed description, which proceeds with reference to the accompanying drawings.

BRIEF SUMMARY

General aspects of the present disclosure relate to weightlifting apparatuses that are connectable to a vertical post of a weight rack or other structure, which may be in the form of a dip apparatus, and which include a brace member for reinforcing a fixed joint between components of the weightlifting apparatus.

Aspects of the disclosure relate to a dip apparatus configured for attachment to a vertical post, including a mounting portion configured for connection to the vertical post, an arm structure comprising a first arm and a second arm extending outwardly and a center portion between the first arm and the second arm, a first handle connected to the first arm and extending outwardly forward and transverse to the first arm, a second handle connected to the second arm and extending outwardly forward and transverse to the second arm, wherein the first handle and the second handle are spaced laterally from each other and are configured for gripping by a user during a dip exercise, and a connecting member having a rear end fixedly connected to the mounting portion and extending longitudinally to a front end fixedly connected to the center portion of the arm structure. The center portion of the arm structure is a tubular structure extending laterally and having a rectangular cross-section formed by a plurality of lateral walls including a rear wall, wherein the rear wall has a lower slot extending therethrough into the central cavity. The front end of the connecting member transversely abuts the rear wall of the tubular structure of the center portion, forming a fixed joint. The connecting member has a rectangular cross-section formed by a plurality of longitudinal walls defining a central cavity, the plurality of longitudinal walls including a bottom wall, and the bottom wall has a slot extending therethrough into the central cavity. A brace member engages the connecting member and the center portion of the arm structure to reinforce the joint, with the brace member having a top surface engaging the bottom wall of the connecting member and a bottom surface of the center portion of the arm structure and a leg extending from the top surface. The leg has an upright portion extending upward from the top surface and through the slot of the connecting member into the central cavity and a protruding portion extending forward from the upright portion within the central cavity. The protruding portion is received in the lower slot of the center portion of the arm structure and engages the rear wall. In this configuration, the connecting member and the brace member fixedly connect the arm structure to the mounting portion.

According to one aspect, the mounting portion has a plurality of side walls defining a channel configured to receive the vertical post therethrough, and at least one of the plurality of side walls has an aperture configured for receiving a fastener therethrough for connection to the vertical post. Additionally, the first arm, the second arm, and the central portion of the arm structure may be formed as a single, continuous tubular structure.

According to another aspect, the connecting member has a second slot extending therethrough into the central cavity, and the rear wall of the central portion of the arm structure has a second lower slot extending therethrough into the central cavity. The brace member further includes a second leg extending from the top surface, with the second leg having a second upright portion extending upward from the top surface and through the second slot of the connecting member into the central cavity and a second protruding portion extending forward from the second upright portion within the central cavity. The second protruding portion is received in the second lower slot of the center portion of the arm structure and engages the rear wall. In one aspect, the brace member may have a U-shaped cross section with two vertical walls having top edges forming the top surface of the brace member, such that the leg and the second leg extend from the top edges of the two vertical walls.

According to a further aspect, the protruding portion of the leg has a notch receiving a portion of the rear wall of the central portion of the arm structure.

According to yet another aspect, the rear wall of the central portion of the arm structure has an upper slot, and the front end of the connecting member has a projection received in the upper slot. In one aspect, the projection may have a notch receiving a portion of the rear wall of the central portion of the arm structure. In another aspect, the rear wall of the central portion of the arm structure may have a second upper slot, and the front end of the connecting member may have a second projection received in the second upper slot.

According to a still further aspect, the top surface of the brace member is welded to the bottom wall of the connecting member and to the bottom surface of the central portion of the arm structure.

According to another aspect, the brace member has a rear located proximate to the mounting portion and a front opposite the rear and located below the arm structure, and wherein the brace member has a height that tapers to decrease from the rear to the front of the brace member.

Additional aspects of the disclosure relate to a weightlifting apparatus including a first tubular member and a second tubular member joined to each other to form a fixed joint, with a brace member engaging the first tubular member and the second tubular member to reinforce the fixed joint. The first tubular member has a first rectangular cross-section formed by a plurality of first walls defining a first central cavity, and the first tubular member extends in a longitudinal direction to a front end. The plurality of first walls includes a bottom wall having a slot extending therethrough into the first central cavity. The second tubular member has a second rectangular cross-section formed by a plurality of second walls defining a second central cavity, with the second tubular member extending in a lateral direction transverse to the longitudinal direction. The plurality of second walls includes a rear wall having a lower slot extending therethrough into the second central cavity. The second tubular member is joined to the first tubular member such that the front end of the first tubular member transversely abuts the rear wall of the second tubular member, forming the fixed joint. The brace member has a top surface engaging the bottom wall of the first tubular member and a bottom surface of the second tubular member and a leg extending from the top surface. The leg has an upright portion extending upward from the top surface and through the slot of the first tubular member into the first central cavity and a protruding portion extending forward from the upright portion within the first central cavity. The protruding portion is received in the lower slot of the second tubular member and engages the rear wall of the second tubular member.

According to one aspect, the first tubular member has a second slot extending therethrough into the first central cavity, and the rear wall of the second tubular member has a second lower slot extending therethrough into the second central cavity. The brace member further includes a second leg extending from the top surface, the second leg having a second upright portion extending upward from the top surface and through the second slot of the first tubular member into the first central cavity and a second protruding portion extending forward from the second upright portion within the first central cavity. The second protruding portion is received in the second lower slot of the second tubular member and engages the rear wall. In one aspect, the brace member may have a U-shaped cross section with two vertical walls having top edges forming the top surface of the brace member, such that the leg and the second leg extend from the top edges of the two vertical walls.

According to another aspect, the protruding portion of the leg has a notch receiving a portion of the rear wall of the central portion of the arm structure.

According to a further aspect, the rear wall of the second tubular member has an upper slot, and the front end of the first tubular member has a projection received in the upper slot. In one aspect, the projection has a notch receiving a portion of the rear wall of the second tubular member. In another aspect, the rear wall of the second tubular member has a second upper slot, and the front end of the first tubular member has a second projection received in the second upper slot.

According to yet another aspect, the top surface of the brace member is welded to the bottom wall of the first tubular member and to the bottom surface of the second tubular member.

Further aspects of the disclosure relate to a weightlifting apparatus configured for attachment to a vertical post, including a mounting portion configured for connection to the vertical post, a longitudinal tubular member having a rear end fixedly connected to the mounting portion and extending in a longitudinal direction from the rear end to a front end, a cross-member joined to the longitudinal tubular member to form a fixed joint and having a rear wall abutting the front end of the longitudinal tubular member and extending in a lateral direction transverse to the longitudinal direction, and a brace member engaging the longitudinal tubular member and the cross-member to reinforce the fixed joint. The longitudinal tubular member has a plurality of walls defining a central cavity, the plurality of walls including a bottom wall having a first slot and a second slot laterally spaced from each other and extending through the bottom wall into the central cavity. The longitudinal tubular member further includes a first projection and a second projection extending forward from the front end on opposite sides of the central cavity. The rear wall of the cross-member has a first lower slot and a second lower slot laterally spaced from each other and a first upper slot and a second upper slot laterally spaced from each other and located above the first and second lower slots. The cross-member is joined to the longitudinal tubular member such that the front end of the longitudinal tubular member transversely abuts the rear wall of the cross-member, forming the fixed joint, and the first and second projections are received in the first and second upper slots, respectively. The brace member has a top surface engaging the bottom wall of the longitudinal tubular member and a bottom surface of the cross-member, and a first leg and a second leg extending from the top surface. The first leg has a first upright portion extending upward from the top surface and through the first slot of the longitudinal tubular member into the central cavity and a first protruding portion extending forward from the first upright portion within the central cavity, where the first protruding portion is received in the first lower slot of the cross-member and engages the rear wall of the cross-member. The second leg has a second upright portion extending upward from the top surface and through the second slot of the longitudinal tubular member into the central cavity and a second protruding portion extending forward from the second upright portion within the central cavity, where the second protruding portion is received in the second lower slot of the cross-member and engages the rear wall of the cross-member.

According to one aspect, the first projection has a first notch receiving a first portion of the rear wall of the cross-member, and the second projection has a second notch receiving a second portion of the rear wall of the cross-member. Additionally, the first protruding portion of the first leg has a third notch receiving a third portion of the rear wall of the cross-member, and the second protruding portion of the second leg has a fourth notch receiving a fourth portion of the rear wall of the cross-member.

Other aspects of the disclosure relate to a method of assembling a dip apparatus or other weightlifting apparatus, including joining a first member and a second member together to form a fixed joint, using a brace member as disclosed herein to engage both the first and second members, reinforcing the fixed joint.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
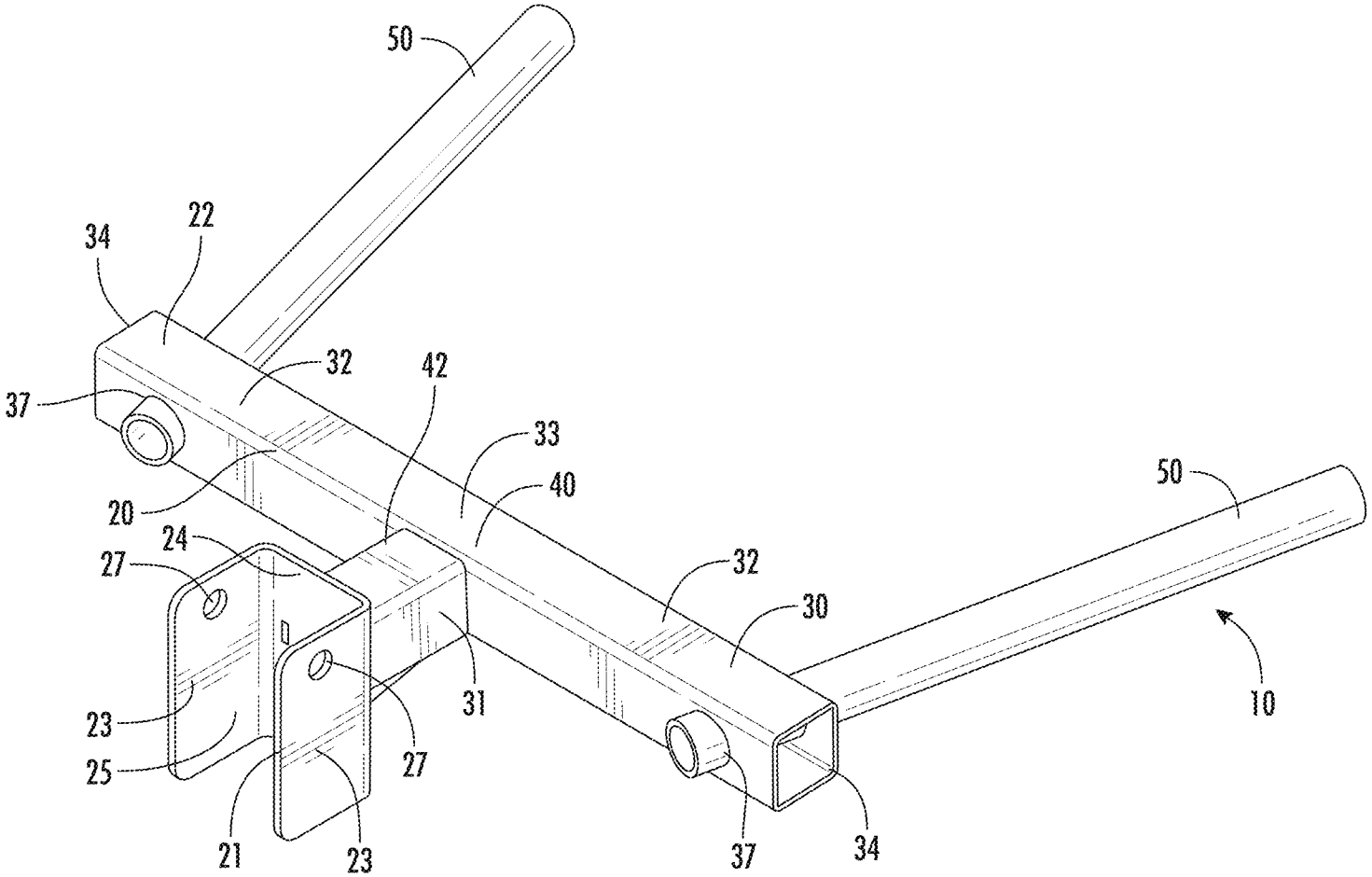
FIG. 1 is a top, rear, perspective view of one embodiment of a weightlifting apparatus in the form of a dip apparatus according to aspects of the present disclosure.
Figure 2:
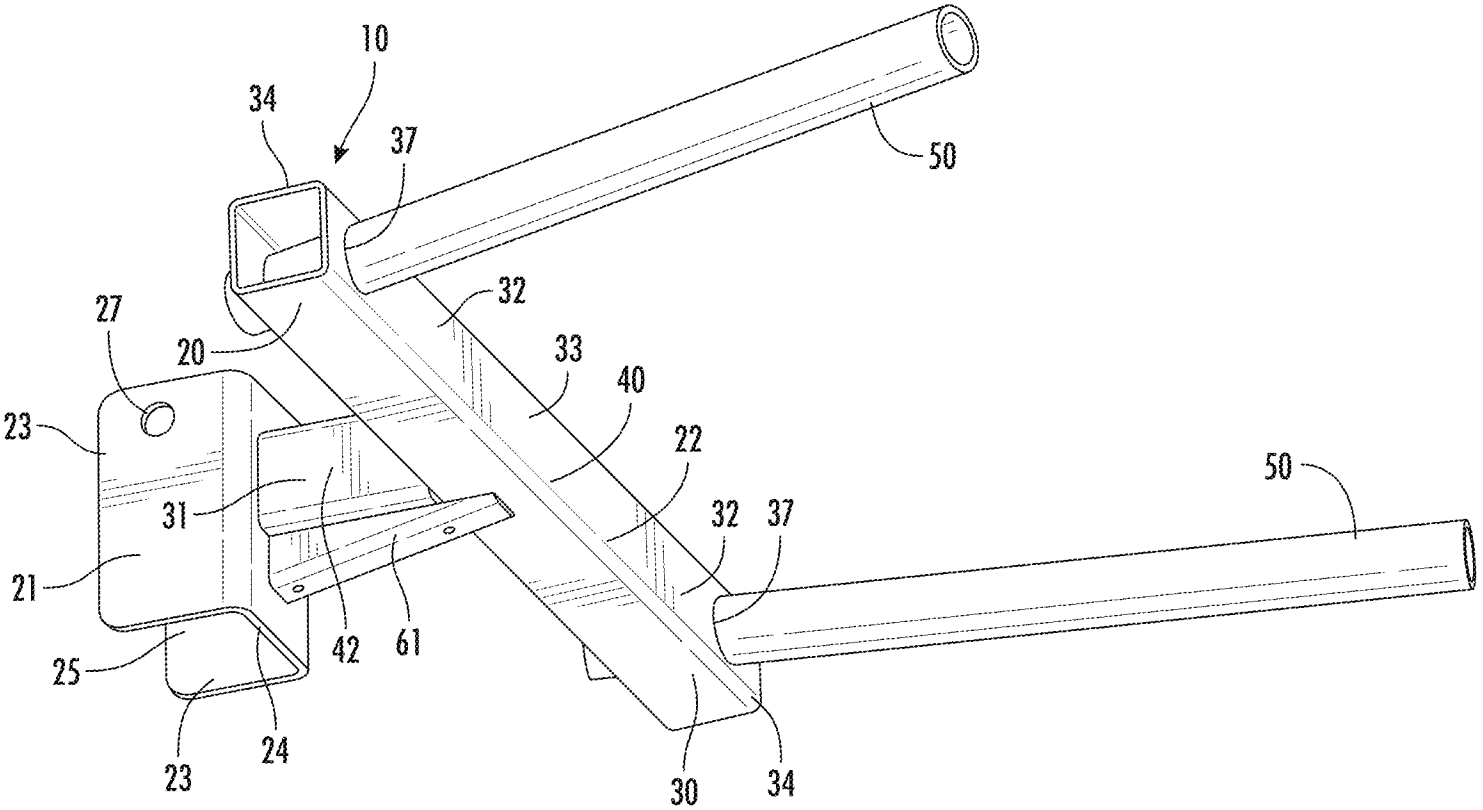
FIG. 2 is a bottom, front, perspective view of the weightlifting apparatus of FIG. 1.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 3:
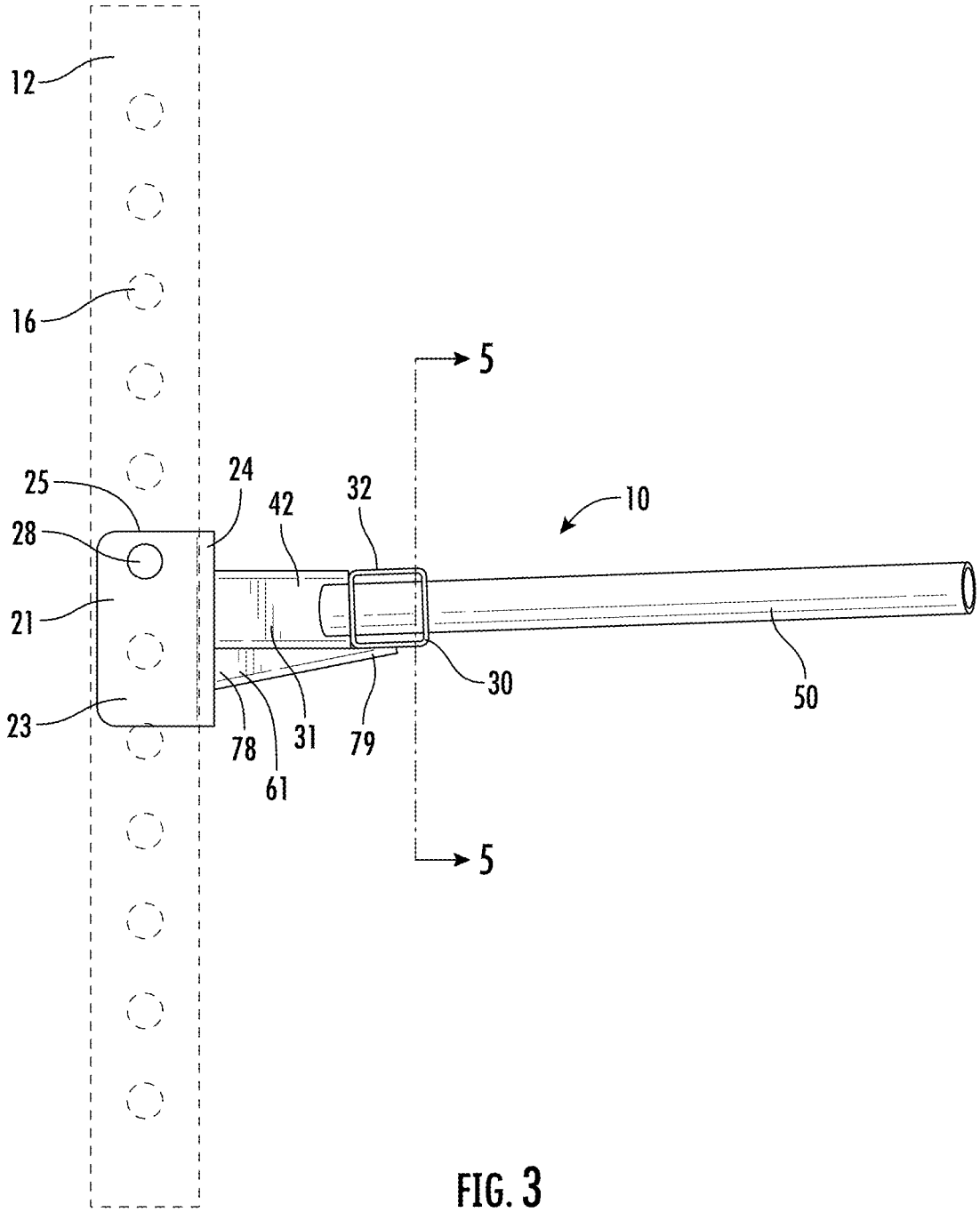
FIG. 3 is a side view of a base of the weightlifting apparatus of FIG. 1, shown in a use position and connected to a weight rack illustrated schematically in broken lines.

Referring to FIGS. 1-5, one embodiment of a weightlifting apparatus 10 is shown that is configured to be connected to a supporting structure in the form of a vertically extending post 12 of a weightlifting rack assembly as shown in FIG. 3. The weightlifting apparatus 10 is configured to be removably attached to the post 12 as described in greater detail herein. The post 12 as shown in FIG. 3 may be a hollow bar formed of a plurality of sidewalls 14, surrounding and defining an interior cavity. In certain embodiments, the post 12 may have a square or other rectangular cross-section. The post 12 may include a plurality of post apertures 16 formed in one or more of the sidewalls 14. In certain embodiments, at least some of the post apertures 16 may be round, and at least some of the post apertures 16 may be keyhole-shaped. The weightlifting apparatus 10 in FIG. 3 is shown connected to the post 12 in a use position, configured for use in a weightlifting exercise.

The weightlifting apparatus 10 in FIGS. 1-5 is in the form of a dip apparatus configured for use in a dip exercise and configured for use as an attachment to a weight rack or similar structure. FIGS. 6-11 illustrate portions of the apparatus 10, and assembly of a portion of the apparatus 10 is illustrated in FIGS. 8-11.

The apparatus 10 has a base 20 configured for connection to the post 12 and two handles 50 connected to the base 20. The base 20 of the apparatus 10 has a mounting portion 21 having structures for connecting the apparatus 10 to the post 12 and a supporting portion 22 having structures for connection to the handles 50. The mounting portion 21 includes two side walls 23 and a front wall 24 configured to define a C-shaped channel 25 to receive the post 12. The side walls 23 and the front wall 24 all may have protective plates (not shown), e.g., made from a high strength polymeric material (including fiber-reinforced polymers), surrounding the channel 25 to resist damage to the post 12 and the apparatus 10 and/or decrease friction. The side walls 23 (and the plates, if present on the side walls 23) have apertures 27 for receiving fasteners, e.g., a removable pin 28 that extends through the side walls 23 (and the plates, if present on the side walls 23), and the post apertures 16, as shown in FIG. 3. FIG. 3 shows the apparatus 10 in a use position, connected to a post 12 using a pin 28.

It is understood that a differently-configured mounting portion may be used in other embodiments for mounting to a vertical weight rack post 12, such as a C-channel having multiple apertures to permit pivoting the apparatus 10 downward to a storage position, a J-cup configuration with a fixed pin, or a flat abutting structure, for example. It is understood that different types of fasteners or other removable connecting structures may be used in connection with the mounting portion 21 in other embodiments, and that the mounting portion 21 may be structured to accommodate such structures. In a further embodiment, the apparatus 10 may be configured for connection to a different type of supporting structure, such as a specially designed support. For example, the apparatus 10 may be configured as a free-standing apparatus with a base structure configured for resting on a floor.

The supporting portion 22 of the apparatus 10 in FIGS. 1-5 has an arm structure 30 configured for mounting of the handles 50 and a connecting portion 31 fixedly connecting the arm structure 30 to the mounting portion 21. The arm structure 30 in this embodiment includes two arms 32 positioned on opposite lateral sides of a lateral centerline passing through a center area or central portion 33 of the arm structure 30 and aligned with the connecting portion 31. It is understood that the "lateral centerline," as used herein, does not extend laterally, but rather represents an imaginary line that passes through the lateral center of the apparatus 10 and extends longitudinally and perpendicular to the lateral direction. The arms 32 extend in substantially opposite directions from the central portion 33 to a distal end 34, such that the arms 32 are positioned on opposite sides of the arm structure 30. The arms 32 are both perpendicular to the lateral centerline and the connecting portion 31 in the embodiment of FIGS. 1-5. However, in another embodiment, the arms 32 may be oriented at an oblique angle to each other and/or an oblique angle to the lateral centerline of the apparatus 10, when viewed vertically downward from above. The arms 32 are formed of a substantially square tubular metallic (e.g., steel) beam or beams in the embodiment of FIGS. 1-5 and have a front wall 35, a rear wall 36, a top wall 38, and a bottom wall 39. In one embodiment, at least a portion of the arm structure 30 (e.g., the center portion 33) is formed of a tubular cross-member 40 that is substantially rectangular (including square shape) and/or has a flat rear wall 36 and bottom wall 39. The central portion 33 and the arms 32 are formed as a single tubular cross-member 40 in the embodiment of FIGS. 1-5, but the arm structure 30 may be formed of multiple members in other embodiments, and the arm structure 30 may be otherwise formed as a single, continuous tubular structure having various configurations in other embodiments.

The connecting portion 31 in FIGS. 1-5 extends forward from the mounting portion 21 to the arm structure 30, and is formed as a single rectangular (e.g., square) tubular connecting member 42 in this embodiment. The connecting member 42 connects to the arm structure 30 at or around the center area 33 of the arm structure 30. The connecting portion 31 may have a different configuration in other embodiments, but may include at least a tubular member in one embodiment, which may be connected directly to the mounting portion 21 or connected through the use of intermediate components. The connecting portion 31 may be connected to the mounting portion 21 using various different connection techniques, and in the embodiment of FIGS. 1-5, the connecting member 42 is connected directly to the front wall 24 of the mounting portion 21 by a welded joint. The connecting portion 31 is connected to the arm structure 30 by a joint structure 60 to create a welded joint as described herein.

The arm structure 30 has holes 37 extending through the arms 32, through the front and rear walls 35, 36 near the distal ends 34. The handles 50 are received through the holes 37 and welded in place to fix the handles 50 to the arms 32. The handles 50 extend outward from the front wall 35 of each arm 32 at an angle configured for use in a dip exercise. In another embodiment, the handles 50 may be removably and/or adjustably connected to the arms 32, such as by use of threaded fasteners or other removable connection structure, including the removable and adjustable connection structure described herein below. The arm structure 30, including the cross-member 40 and the arms 32 (which are a single-piece structure in the apparatus 10 of FIGS. 1-5), is oriented at a slight rotational angle about the lateral axis with respect to the connecting member 42, such that the handles 50 are angled slightly upwardly with respect to the longitudinal direction, as shown in FIG. 3.

Figure 4:
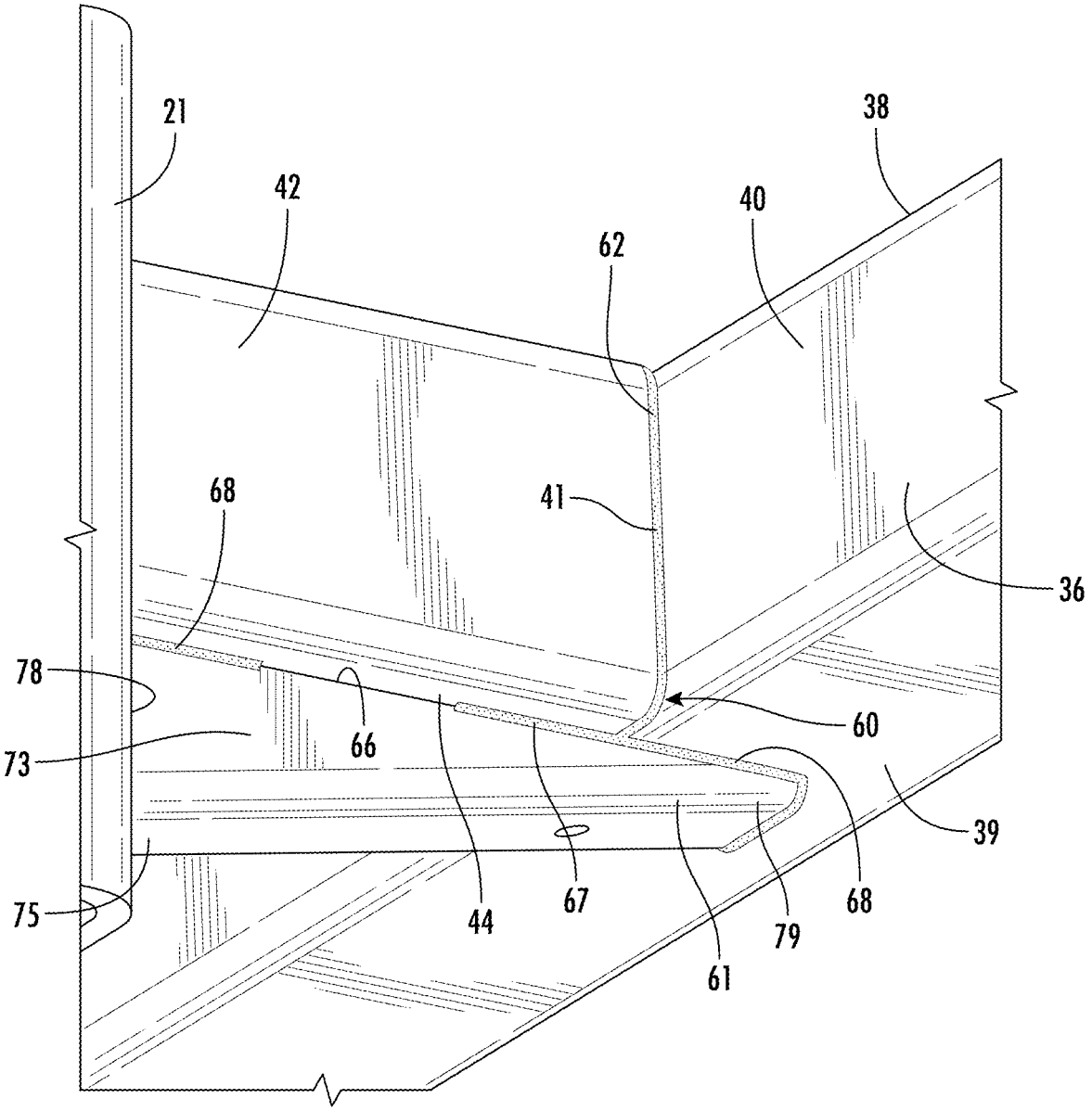
FIG. 4 is a magnified bottom rear perspective view of a portion of the weightlifting apparatus of FIG. 1.
Figure 7:
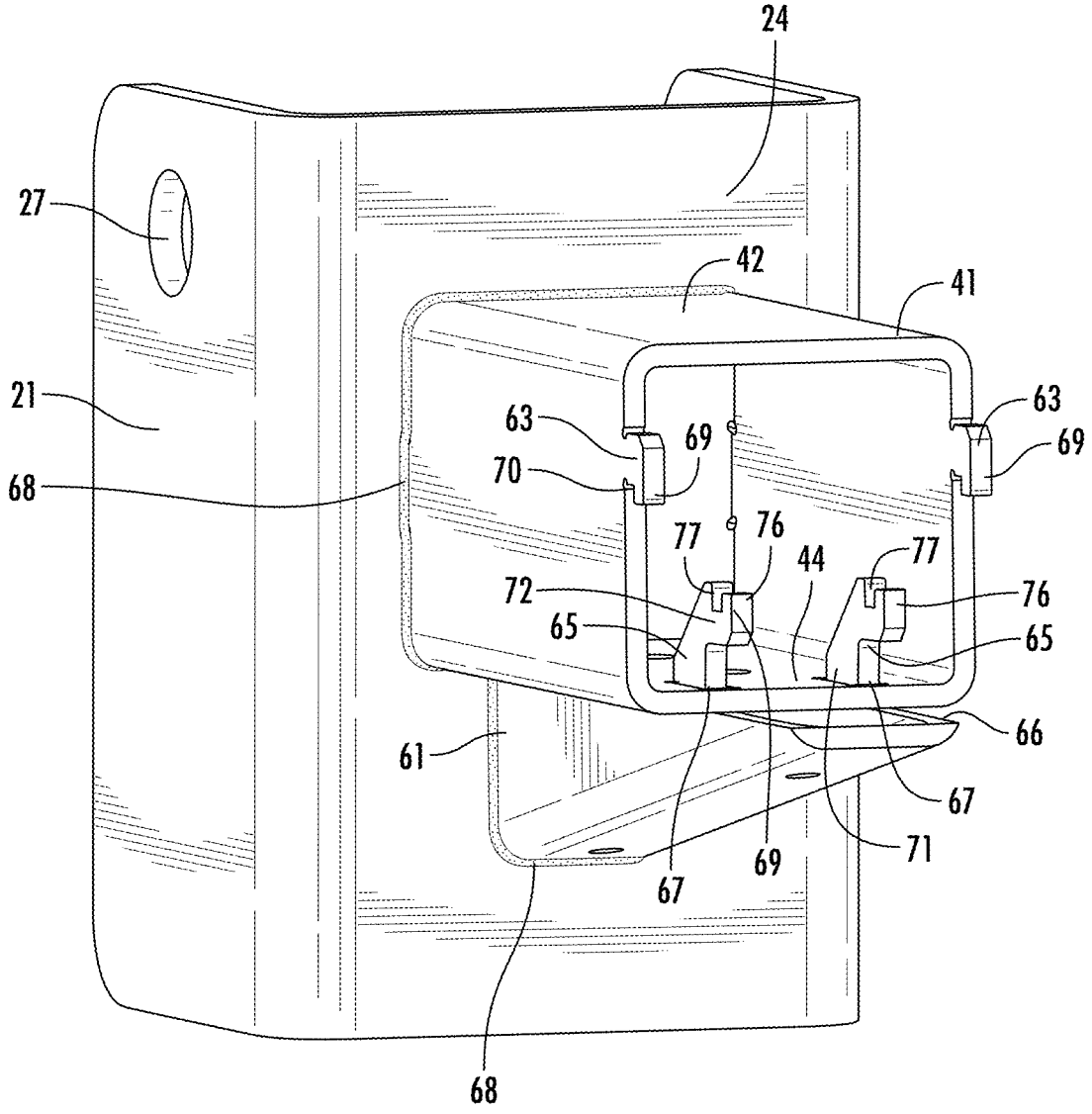
FIG. 7 is a top, front, perspective view of a portion of the weightlifting apparatus of FIG. 1.

The components and assembly of the joint structure 60 in the embodiment of FIGS. 1-5 are shown in greater detail in FIGS. 6-11. In this configuration, the joint structure 60 is formed of the connecting member 42, a portion of the arm structure 30 (e.g., the cross-member 40 at the center area 33), and a brace member 61 that engages both the connecting member 42 and the cross-member 40. The cross-member 40 has one or more upper slots 62 in the rear wall 36 that receive one or more projections 63 extending from a front end 41 of the connecting member 42 and one or more lower slots 64 in the rear wall 36 that receive one or more legs 65 extending from a top surface 66 of the brace member 61. The brace member 61 has a U-shaped cross section with a base wall 75 and two vertical walls 73 having top edges 74 forming the top surface 66 of the brace member 61. Each leg 65 extends from the top edge 74 of one of the two vertical walls 73. The base wall 75 is inclined toward the top surface 66 in the configuration of FIGS. 1-11, and the heights of the vertical walls 73 taper, such that the height of the brace member 61 is greatest at the rear end 78 near the mounting portion 21 and decreases to the smallest at the front end 79. The connecting member 42 also has one or more slots 67 through a bottom wall 44 thereof. The leg(s) 65 of the brace member 61 extend through the slot(s) 67 in the connecting member 42, through a central cavity 45 of the connecting member 42 and into the lower slot(s) 64 of the cross-member 40. The cross-member 40, the connecting member 42, and the brace member 61 can then be welded together, such that the projection(s) 63 are welded within the upper slot(s) 62 and the leg(s) 65 are welded within the lower slot(s) 64. FIGS. 4 and 7 illustrate one example welding configuration, with weldments 68 including: (A) the brace member 61 welded to the cross-member 40, the connecting member 42, and the front wall 24 of the mounting portion 21; (B) the cross-member 40 welded to the connecting member 42; and (C) the connecting member 42 welded to the front wall 24 of the mounting portion 21.

Figure 5:
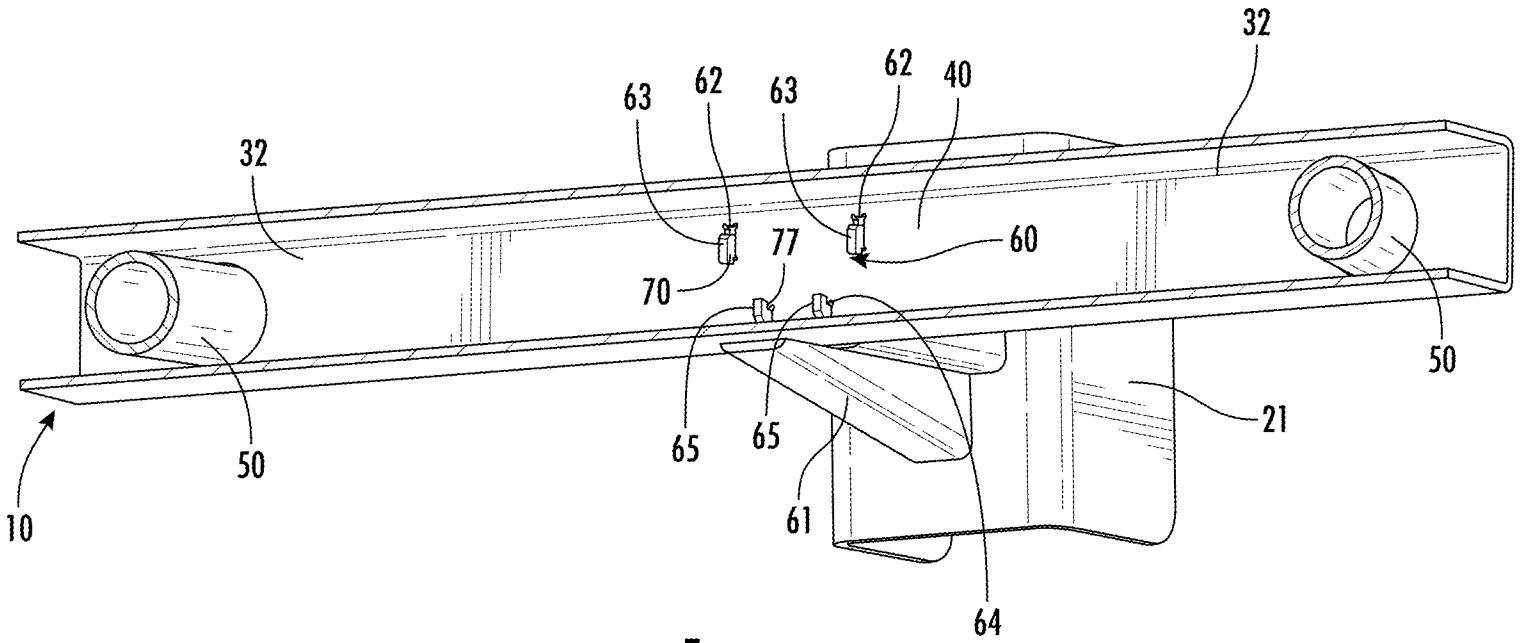
FIG. 5 is a cross-section view taken along lines 5-5 in FIG. 3.
Figure 6:
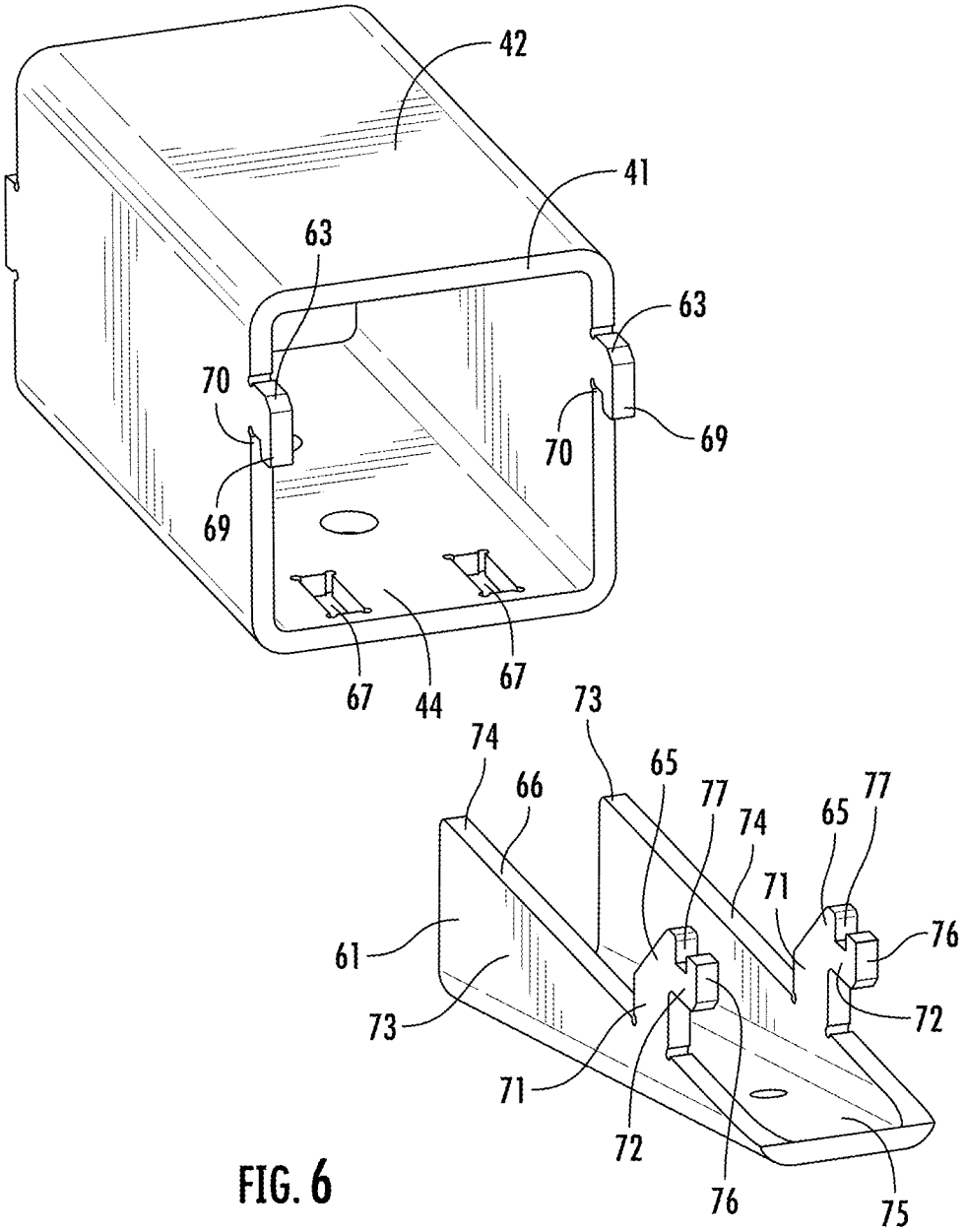
FIG. 6 is an exploded top, front, perspective view of components of a joint structure of the weightlifting apparatus of FIG. 1.
Figure 9:
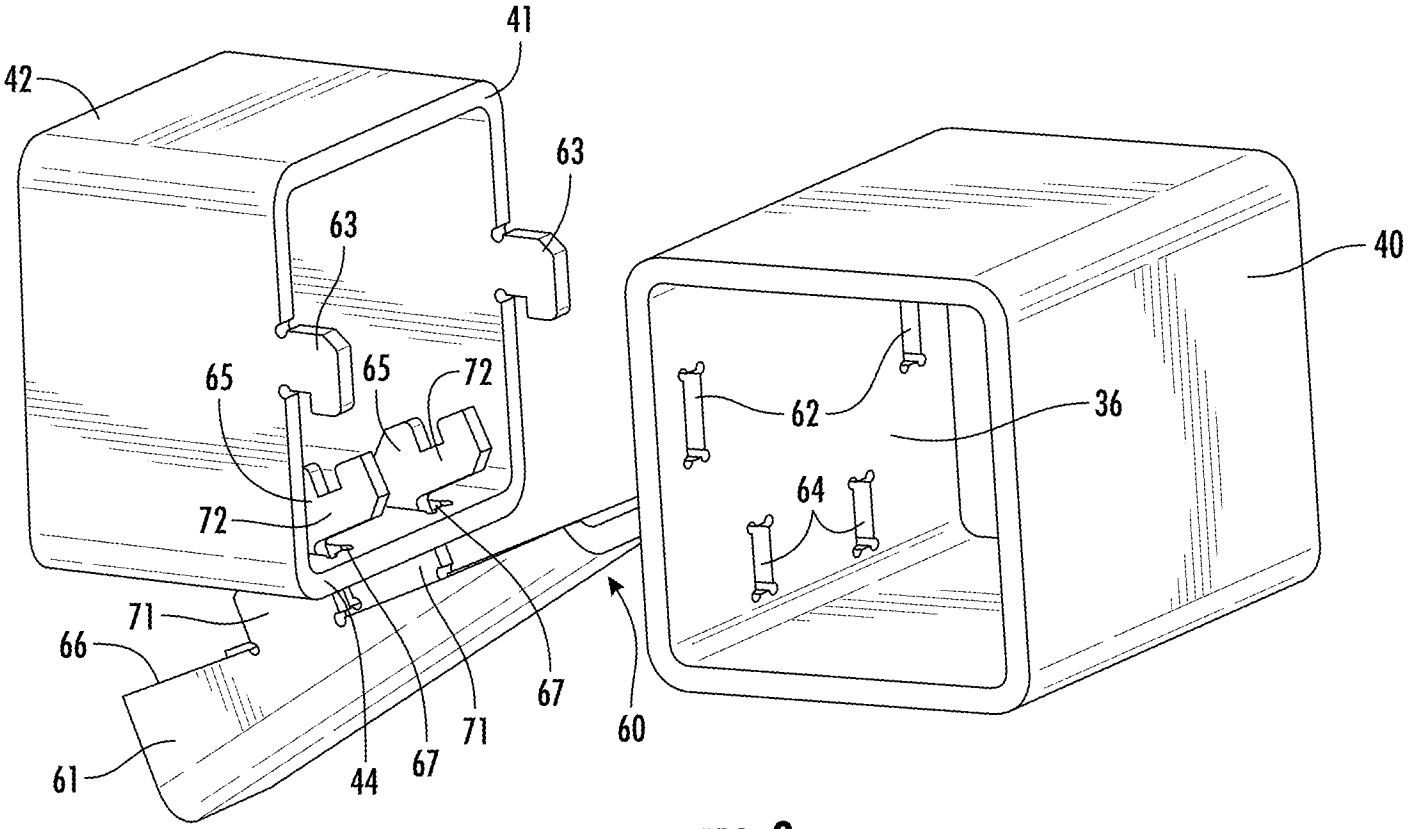
FIG. 9 is an exploded view of the components of the joint structure of the weightlifting apparatus of FIG. 8, shown in a second stage of assembly.
Figure 10:
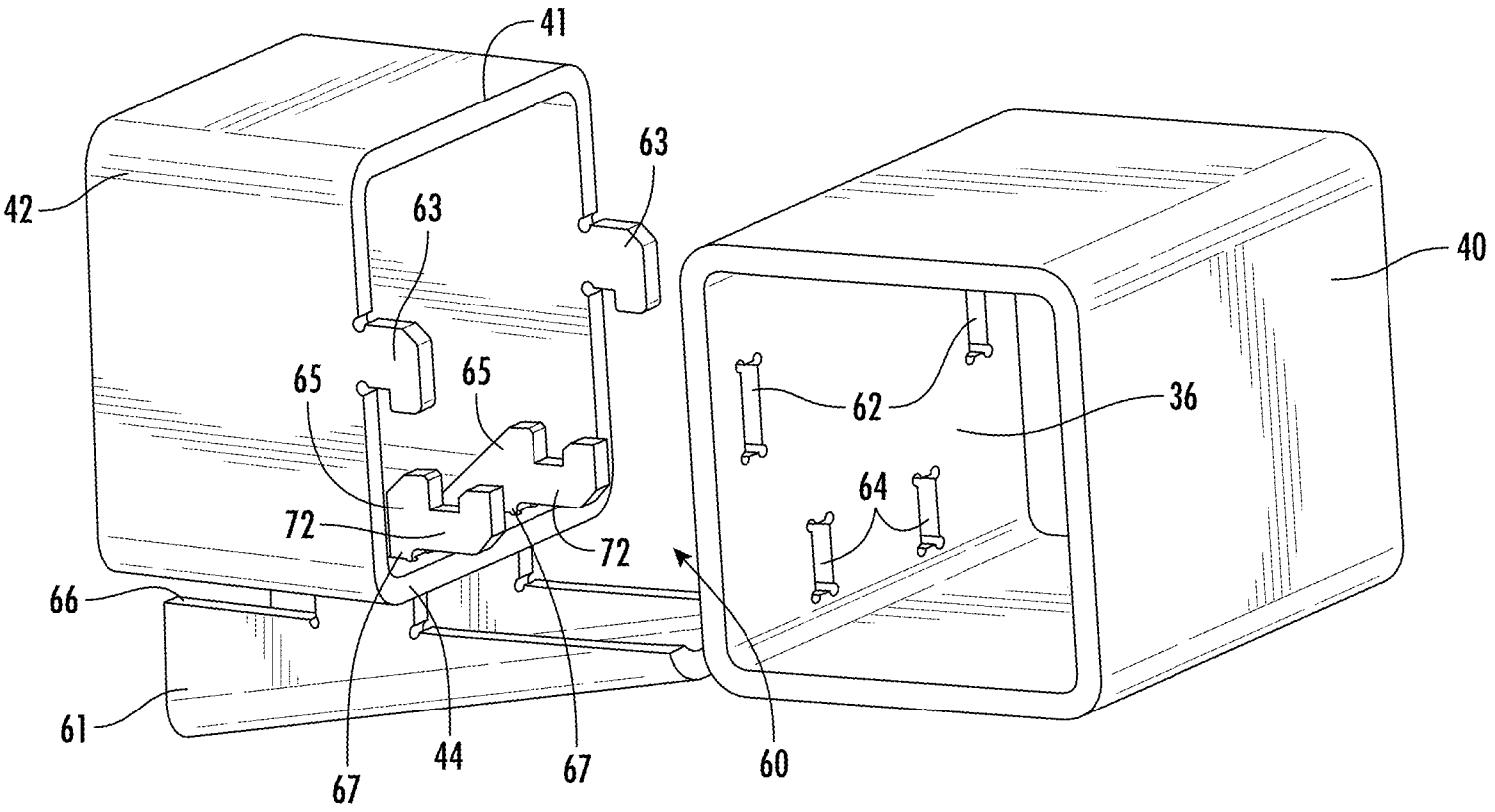
FIG. 10 is an exploded view of the components of the joint structure of the weightlifting apparatus of FIG. 8, shown in a third stage of assembly.
Figure 11:
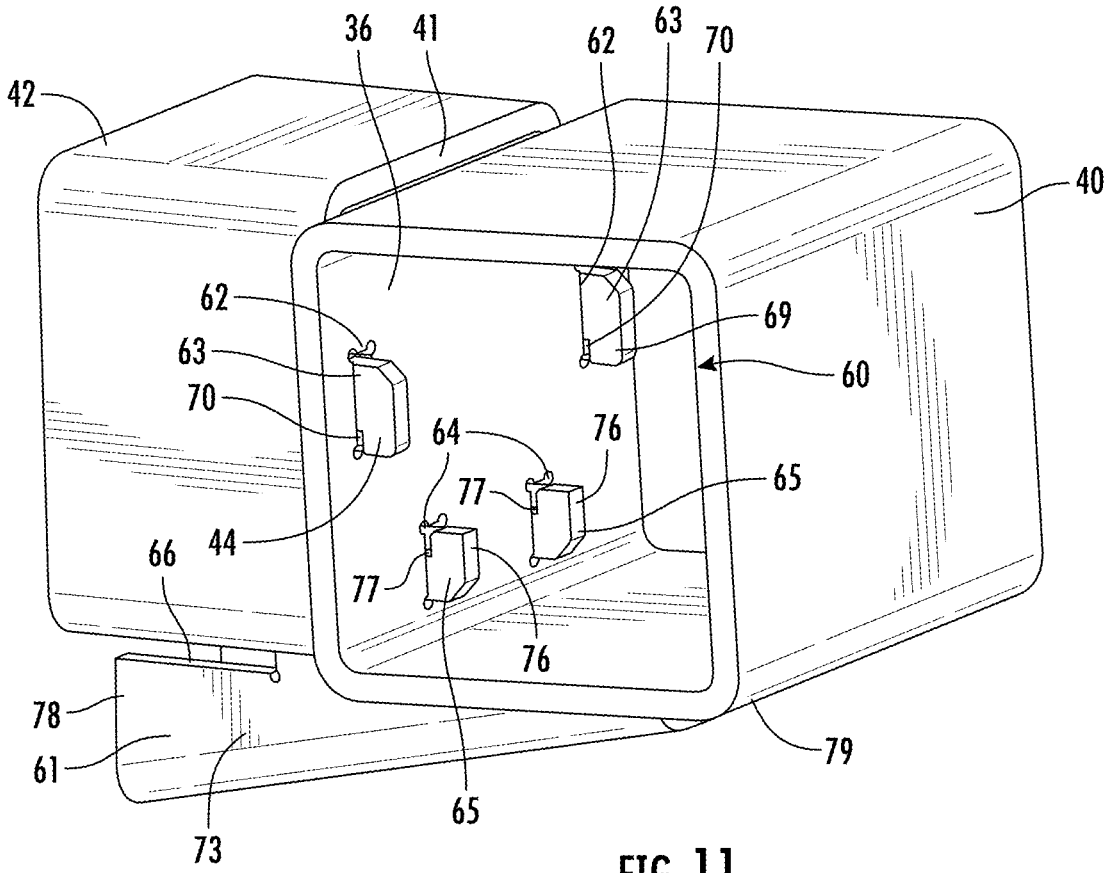
FIG. 11 is an assembled view of the components of the joint structure of the weightlifting apparatus of FIG. 8.

In the embodiment of FIGS. 1-11, the connecting member 42 has two slots 67 in the bottom wall 44 that are elongated along the longitudinal direction, and the cross-member 40 has two upper slots 62 and two lower slots 64 that are all elongated vertically. The upper slots 62 are positioned at the same vertical heights, and the lower slots 64 are spaced at the same vertical heights, which are lower than the upper slots 62. Additionally, the upper slots 62 are spaced further apart laterally than the lower slots 64. The connecting member 42 has two projections 63 that extend forward from the opposed side edges of the front end 41 and have fingers 69 extending downward to form the projections 63 in a hook shape. The brace member 61 has a U-shape in cross-section over most of its length, and two legs 65 extend upward and forward from the opposed edges of the U-shape at the top surface 66 of the brace member 61. The legs 65 also have fingers 76 extending upward at the ends to form the ends of the legs 65 in a hook shape. The fingers 69, 76 on both the projections 63 and the legs 65 define notches 70, 77 that may receive portions of the rear wall 36 of the cross-member 40, as shown in FIGS. 5 and 11. Each of the legs 65 in the embodiment of FIGS. 1-11 includes an upright portion 71 extending upward from the top surface 66 of the brace member 61 and a protruding portion 72 extending forward from the upright portion 71, with the finger 76 extending upward from the end of the protruding portion 72. The notch 77 is formed between the upright portion 71 and the finger 76. In the embodiment of FIGS. 1-11, the upright portion 71 is substantially triangular in shape, being wider at the top surface 66 of the brace member 61 and tapering to a point at the top end thereof.

Figure 8:
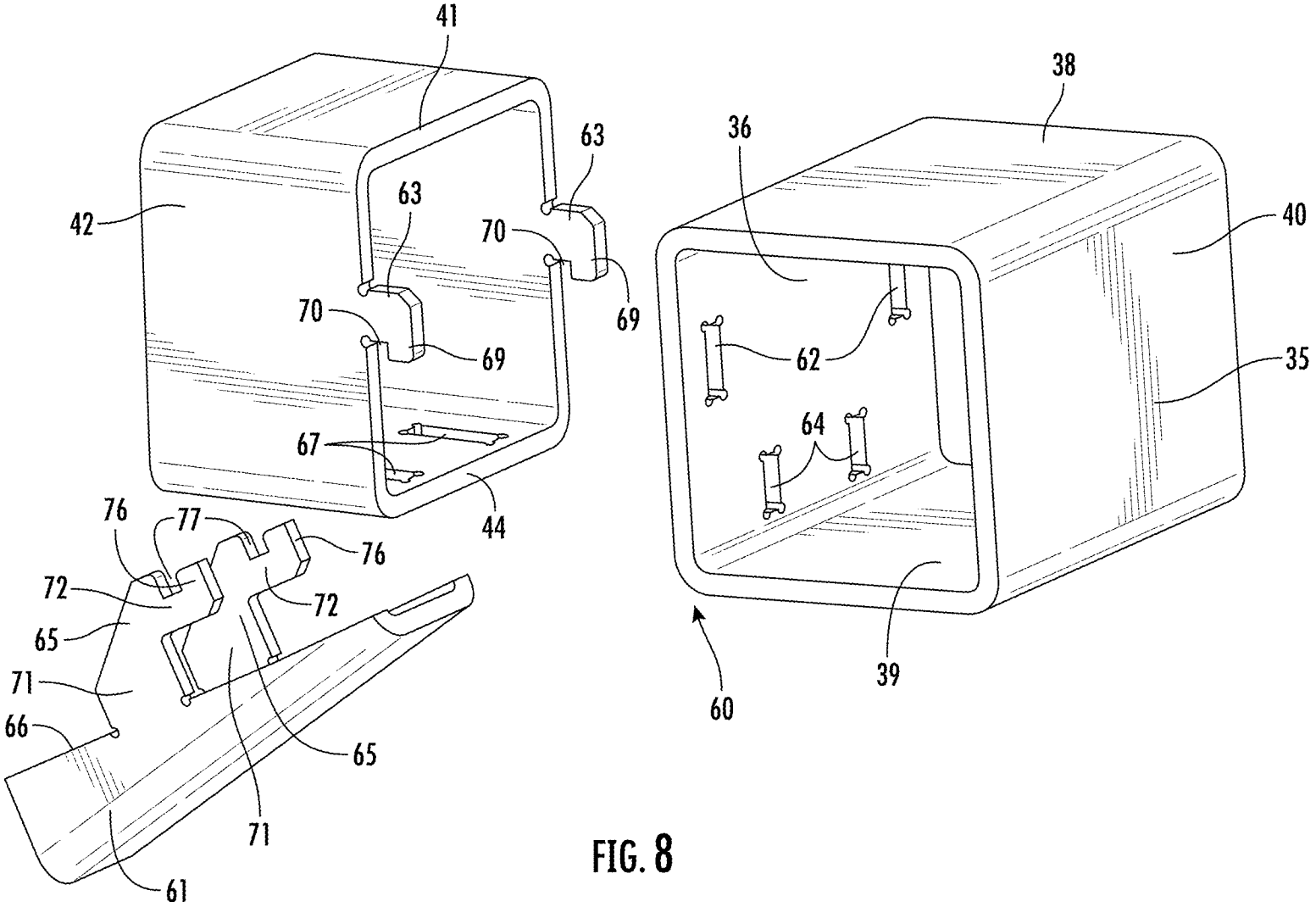
FIG. 8 is an exploded view of components of the joint structure of the weightlifting apparatus of FIG. 1, shown in a first stage of assembly of one embodiment according to aspects of the disclosure.

Assembly of the joint structure 60 is shown in FIGS. 8-11. As shown in FIGS. 8-9, the brace member 61 is angled with respect to the connecting member 42 to insert the legs 65 through the slots 67 in the connecting member 42. The brace member 61 is then rotated to bring the top surface 66 of the brace member 61 adjacent to the bottom wall 44 of the connecting member 42, such that the protruding portions 72 of the legs 65 extend forward, as shown in FIG. 10. In this configuration, the upright portions 71 of the legs 65 extend through the slots 67 in the connecting member 42. The cross-member 40 is then moved into engagement with the connecting member 42 and the brace member 61, such that the projections 63 are received in the upper slots 62 and the protruding portions 72 of the legs 65 are received in the lower slots 64. In this configuration, the rear wall 36 of the cross-member 40 is engaged with and welded, or otherwise joined using an integral joining technique, to the front end 41 of the connecting member 42. Additionally, the top surface 66 of the brace member 61 is engaged with and welded, or otherwise joined using an integral joining technique, to both the bottom wall 44 of the connecting member 42 and the bottom wall 39 of the cross-member 40. As discussed herein, the protruding portions 72 of the legs 65 and the projections 63 are engaged with the rear wall 36 of the cross-member 40 and may be welded, or otherwise joined using an integral joining technique, to the rear wall 36 of the cross-member 40.

Figure 12:
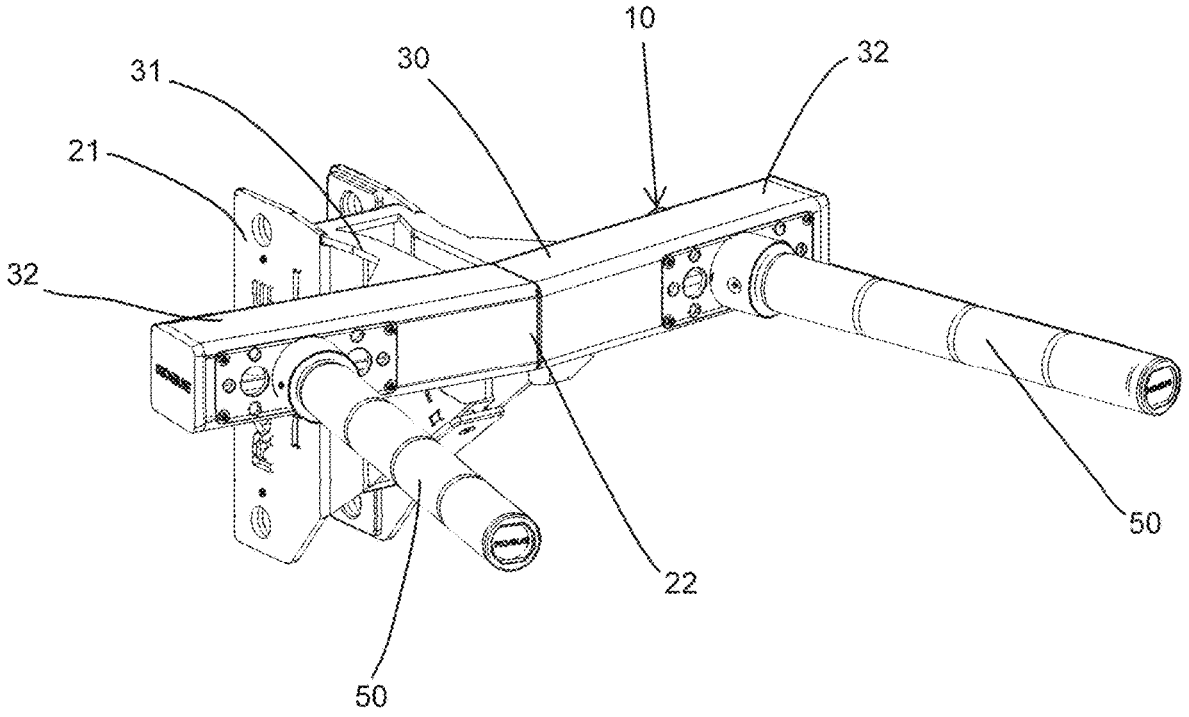
FIG. 12 is a top, front, perspective view of another embodiment of a weightlifting apparatus in the form of a dip apparatus that is usable with a joint structure according to aspects of the present disclosure.

The connection joint structure 60 and components thereof as described herein may be used with other structures for connection to a weight rack, including dip apparatuses and other weightlifting apparatuses. FIG. 12 illustrates another embodiment of a dip apparatus 10 having adjustable handles 50, as shown and described in U.S. Provisional Application No. 63/424,640, filed Nov. 11, 2022, the entire disclosure of which is incorporated by reference herein in its entirety. The joint structure 60 as disclosed herein may be implemented for connecting to the arm structure 30 of the dip apparatus 10 in FIG. 12. Alternately, the arm structure 30 and the handles 50 of the dip apparatus 10 in FIG. 12 may be incorporated into the dip apparatus 10 of FIGS. 1-11.

Various embodiments of weightlifting apparatuses and attachments have been described herein, which include various components and features. In other embodiments, the weightlifting apparatuses and attachments may be provided with any combination of such components and features. It is also understood that in other embodiments, the various devices, components, and features of the weightlifting apparatuses and attachments described herein may be constructed with similar structural and functional element/s having different configurations, including different ornamental appearances.

The apparatus 10 described herein provides multiple benefits and advantages over existing dip apparatuses and other weightlifting attachments. For example, the structure provides improved engagement between components of the joint structure 60, allowing greater weld strength to be achieved. Additionally, the engagement between cross-member 40 and the notches 70 is sufficient to hold the cross-member 40 in engagement with the connecting member 42 without welding or other joining. This may stabilize the structure of the apparatus 10 if the weldments in the joint structure 60 fracture or otherwise separate during use. Still further benefits and advantages are recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. When used in description of a method or process, the term "providing" (or variations thereof) as used herein means generally making an article available for further actions, and does not imply that the entity "providing" the article manufactured, assembled, or otherwise produced the article. The term "approximately" as used herein implies a variation of up to 10% of the nominal value modified by such term, or up to 10% of a midpoint value of a range modified by such term. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A dip apparatus configured for attachment to a vertical post, the dip apparatus comprising:

a mounting portion configured for connection to the vertical post;

an arm structure comprising a first arm and a second arm extending outwardly and a center portion between the first arm and the second arm, wherein the center portion of the arm structure is a tubular structure extending laterally and having a rectangular cross-section formed by a plurality of lateral walls including a rear wall, wherein the rear wall has a lower slot extending therethrough into an arm structure central cavity defined by the tubular structure;

a first handle connected to the first arm and extending outwardly forward and transverse to the first arm;

a second handle connected to the second arm and extending outwardly forward and transverse to the second arm, wherein the first handle and the second handle are spaced laterally from each other and are configured for gripping by a user during a dip exercise;

a connecting member having a rear end fixedly connected to the mounting portion and extending longitudinally to a front end fixedly connected to the center portion of the arm structure such that the front end of the connecting member transversely abuts the rear wall of the tubular structure of the center portion, forming a fixed joint, the connecting member having a rectangular cross-section formed by a plurality of longitudinal walls defining a connecting member central cavity, the plurality of longitudinal walls including a bottom wall, wherein the bottom wall has a slot extending therethrough into a connecting member central cavity; and a brace member engaging the connecting member and the center portion of the arm structure to reinforce the fixed joint, the brace member having a top surface engaging the bottom wall of the connecting member and a bottom surface of the center portion of the arm structure and a leg extending from the top surface, the leg having an upright portion extending upward from the top surface and through the slot of the connecting member into a connecting member central cavity and a protruding portion extending forward from the upright portion within a connecting member central cavity, wherein the protruding portion is received in the lower slot of the center portion of the arm structure and engages the rear wall, wherein the connecting member and the brace member fixedly connect the arm structure to the mounting portion.

2. The dip apparatus of claim 1, wherein the mounting portion comprises a plurality of side walls defining a channel configured to receive the vertical post therethrough, wherein at least one of the plurality of side walls has an aperture configured for receiving a fastener therethrough for connection to the vertical post, and wherein the first arm, the second arm, and the center portion of the arm structure are formed as a single, continuous tubular structure.

3. The dip apparatus of claim 1, wherein the connecting member has a second slot extending therethrough into a connecting member central cavity, and the rear wall of the center portion of the arm structure has a second lower slot extending therethrough into a connecting member central cavity, and wherein the brace member further comprises a second leg extending from the top surface, the second leg having a second upright portion extending upward from the top surface and through the second slot of the connecting member into a connecting member central cavity and a second protruding portion extending forward from the second upright portion within a connecting member central cavity, wherein the second protruding portion is received in the second lower slot of the center portion of the arm structure and engages the rear wall.

4. The dip apparatus of claim 3, wherein the brace member has a U-shaped cross section with two vertical walls having top edges forming the top surface of the brace member, wherein the leg and the second leg extend from the top edges of the two vertical walls.

5. The dip apparatus of claim 1, wherein the protruding portion of the leg has a notch receiving a portion of the rear wall of the center portion of the arm structure.

6. The dip apparatus of claim 1, wherein the rear wall of the center portion of the arm structure has an upper slot, and the front end of the connecting member has a projection received in the upper slot.

7. The dip apparatus of claim 6, wherein the projection has a notch receiving a portion of the rear wall of the center portion of the arm structure.

8. The dip apparatus of claim 6, wherein the rear wall of the center portion of the arm structure has a second upper slot, and the front end of the connecting member has a second projection received in the second upper slot.

9. The dip apparatus of claim 1, wherein the top surface of the brace member is welded to the bottom wall of the connecting member and to the bottom surface of the center portion of the arm structure.

10. The dip apparatus of claim 1, wherein the brace member has a rear located proximate to the mounting portion and a front opposite the rear and located below the arm structure, and wherein the brace member has a height that tapers to decrease from the rear to the front of the brace member.

11. A weightlifting apparatus comprising:

a first tubular member having a first rectangular cross-section formed by a plurality of first walls defining a first central cavity, the plurality of first walls including a bottom wall, the first tubular member extending in a longitudinal direction to a front end, wherein the bottom wall has a slot extending therethrough into the first central cavity;

a second tubular member having a second rectangular cross-section formed by a plurality of second walls defining a second central cavity, the plurality of second walls including a rear wall, the second tubular member extending in a lateral direction transverse to the longitudinal direction, wherein the rear wall has a lower slot extending therethrough into the second central cavity, and wherein the second tubular member is joined to the first tubular member such that the front end of the first tubular member transversely abuts the rear wall of the second tubular member, forming a fixed joint; and a brace member engaging the first tubular member and the second tubular member to reinforce the fixed joint, the brace member having a top surface engaging the bottom wall of the first tubular member and a bottom surface of the second tubular member and a leg extending from the top surface, the leg having an upright portion extending upward from the top surface and through the slot of the first tubular member into the first central cavity and a protruding portion extending forward from the upright portion within the first central cavity, wherein the protruding portion is received in the lower slot of the second tubular member and engages the rear wall of the second tubular member.

12. The weightlifting apparatus of claim 11, wherein the first tubular member has a second slot extending therethrough into the first central cavity, and the rear wall of the second tubular member has a second lower slot extending therethrough into the second central cavity, and wherein the brace member further comprises a second leg extending from the top surface, the second leg having a second upright portion extending upward from the top surface and through the second slot of the first tubular member into the first central cavity and a second protruding portion extending forward from the second upright portion within the first central cavity, wherein the second protruding portion is received in the second lower slot of the second tubular member and engages the rear wall.

13. The weightlifting apparatus of claim 12, wherein the brace member has a U-shaped cross section with two vertical walls having top edges forming the top surface of the brace member, wherein the leg and the second leg extend from the top edges of the two vertical walls.

14. The weightlifting apparatus of claim 11, wherein the protruding portion of the leg has a notch receiving a portion of the rear wall of the second tubular member.

15. The weightlifting apparatus of claim 11, wherein the rear wall of the second tubular member has an upper slot, and the front end of the first tubular member has a projection received in the upper slot.

16. The weightlifting apparatus of claim 15, wherein the projection has a notch receiving a portion of the rear wall of the second tubular member.

17. The weightlifting apparatus of claim 15, wherein the rear wall of the second tubular member has a second upper slot, and the front end of the first tubular member has a second projection received in the second upper slot.

18. The weightlifting apparatus of claim 11, wherein the top surface of the brace member is welded to the bottom wall of the first tubular member and to the bottom surface of the second tubular member.

19. A weightlifting apparatus configured for attachment to a vertical post, the weightlifting apparatus comprising:

a mounting portion configured for connection to the vertical post;

a longitudinal tubular member having a rear end fixedly connected to the mounting portion and extending in a longitudinal direction from the rear end to a front end, the longitudinal tubular member having a plurality of walls defining a central cavity, the plurality of walls including a bottom wall, wherein the bottom wall has a first slot and a second slot laterally spaced from each other and extending through the bottom wall into the central cavity, and wherein the longitudinal tubular member further comprises a first projection and a second projection extending forward from the front end on opposite sides of the central cavity;

a cross-member having a rear wall abutting the front end of the longitudinal tubular member and extending in a lateral direction transverse to the longitudinal direction, wherein the rear wall has a first lower slot and a second lower slot laterally spaced from each other and a first upper slot and a second upper slot laterally spaced from each other and located above the first and second lower slots, and wherein the cross-member is joined to the longitudinal tubular member such that the front end of the longitudinal tubular member transversely abuts the rear wall of the cross-member, forming a fixed joint, and the first and second projections are received in the first and second upper slots, respectively; and a brace member engaging the longitudinal tubular member and the cross-member to reinforce the fixed joint, the brace member having a top surface engaging the bottom wall of the longitudinal tubular member and a bottom surface of the cross-member, and a first leg and a second leg extending from the top surface, the first leg having a first upright portion extending upward from the top surface and through the first slot of the longitudinal tubular member into the central cavity and a first protruding portion extending forward from the first upright portion within the central cavity, wherein the first protruding portion is received in the first lower slot of the cross-member and engages the rear wall of the cross-member, and the second leg having a second upright portion extending upward from the top surface and through the second slot of the longitudinal tubular member into the central cavity and a second protruding portion extending forward from the second upright portion within the central cavity, wherein the second protruding portion is received in the second lower slot of the cross-member and engages the rear wall of the cross-member.

20. The weightlifting apparatus of claim 19, wherein the first projection has a first notch receiving a first portion of the rear wall of the cross-member, the second projection has a second notch receiving a second portion of the rear wall of the cross-member, the first protruding portion of the first leg has a third notch receiving a third portion of the rear wall of the cross-member, and the second protruding portion of the second leg has a fourth notch receiving a fourth portion of the rear wall of the cross-member.

* * * * *